US005980588A

United States Patent [19]

Valmassoi

[11] Patent Number: 5,980,588

[45] Date of Patent: Nov. 9, 1999

[54] METHOD FOR SURFACE COLORING PLASTIC OBJECTS AFTER MANUFACTURE

[75] Inventor: Osvaldo Valmassoi, Domegge di Cadore, Italy

[73] Assignee: Aurochim Industria S.r.l., Lozzo di Codore, Italy

[21] Appl. No.: 09/149,106

[22] Filed: Sep. 8, 1998

[30] Foreign Application Priority Data

Sep. 18, 1997 [IT] Italy ..... PD97A0207

[51] Int. Cl.[6] ..... D06P 5/02

[52] U.S. Cl. ..... 8/467; 8/474; 8/506; 8/637.1

[58] Field of Search ..... 8/467, 469, 474, 8/506, 637.1, 933, 471; 101/34

[56] References Cited

U.S. PATENT DOCUMENTS

| | | | |
|---|---|---|---|
| 3,860,388 | 1/1975 | Haigh | 8/471 |
| 4,059,471 | 11/1977 | Haigh | 8/468 |
| 4,465,728 | 8/1984 | Haigh et al. | 8/471 |
| 4,541,340 | 9/1985 | Peart et al. | 8/471 |
| 4,587,155 | 5/1986 | Durand | 8/467 |
| 4,619,665 | 10/1986 | Sideman et al. | 8/470 |
| 4,668,239 | 5/1987 | Durand | 8/471 |

FOREIGN PATENT DOCUMENTS 2155430 5/1973 Germany .

OTHER PUBLICATIONS

English language translation of DE 2,155,430, Imperial Chemical Ind, pp. 1–15, May 1973.

*Primary Examiner*—Caroline D. Liott
*Attorney, Agent, or Firm*—Guido Modiano; Albert Josif

[57] ABSTRACT

A method for surface coloring plastic objects after manufacture. The method consists of a first step for impregnating a printed paper substrate, whereon pigments of the family known as disperse inks and/or sublimatic inks are deposited within the printing inks, with an aqueous solution of a solvent which activates the print and is capable of activating the surface of the plastic to be treated. Another step consists in covering the parts of the object to be treated with the paper substrate and in then removing the substrate and drying the parts. The final step consists of introduction into an atmosphere of vapors of a product which is a solvent for the pigments, for a time sufficient to fix the pigments to the surface.

3 Claims, No Drawings

METHOD FOR SURFACE COLORING PLASTIC OBJECTS AFTER MANUFACTURE

BACKGROUND OF THE INVENTION

The present invention relates to a method for surface coloring plastic objects after manufacture.

It is known that the market increasingly demands the thermal dye-sublimation printing method to produce particular aesthetic effects on a wide range of products or for reproducing images on objects of various kinds.

This context accordingly includes the manufacture of products having a simple structure and considerable dimensions, such as plastic surfaces of pieces of furniture printed so as to imitate wood or marble, but also of small objects having a complex structure, such as containers for cosmetics, ornamental objects, small electric household appliances and frames for glasses, in which various and mostly complex color effects are obtained.

These productions are currently performed by means of thermal sublimation dyes which are deposited on a sheet substrate arranged so as to cover the parts to be treated and are then heated, together with the object being treated, to a temperature whereat the dyes sublimate and fix to the object.

One of the current problems of this type of treatment is due to the fact that the sublimation temperature is around 150–200° C., which is unacceptably high for many of the plastics employed, such as ABS, acetal plastics, styrenes and acetates,-whose structure softens when heated to the temperature whereat the pigments sublimate.

This is a considerable limitation, because softening in practice leads, on subsequent cooling, to deformations of the product compromising its quality and the possibility to market it.

As an alternative to the transfer of dyes by sublimation, screen-printing or tampographic methods are used; however, they are adapted for objects having a simple and not particularly complex shape.

SUMMARY OF THE INVENTION

The aim of the present invention is to provide a method for surface coloring plastic objects after manufacture which can be performed cold or in any case at temperatures below the softening temperature of the plastics whereof the objects are made.

Within the scope of this aim, a consequent primary object is to provide a method which can be applied even to objects having a complex shape.

Another important object is to provide a method which has a low cost.

Another object is to provide a method which can be used in the most disparate fields, including in particular the eyewear industry.

This aim, these objects and others which will become apparent hereinafter are achieved by a method for surface coloring plastic objects after manufacture, comprising the steps of:

impregnating a printed paper substrate, whereon pigments of the family known as disperse inks and/or sublimatic inks are deposited within the printing inks, with an aqueous solution of a solvent which activates the print and is capable of activating the surface of the plastic to be treated;

covering the parts of the object to be treated with the paper substrate, so as to transfer the print from the paper to the object;

removing the substrate and subjecting the parts being treated to drying;

introducing the parts being treated into an atmosphere of vapors of a product which is a solvent for said pigments, for a time sufficient to activate the pigments and to fix them to the plastic whereon they are deposited.

DETAILED DESCRIPTION OF THE INVENTION

Further characteristics and advantages of the present invention will become apparent from the following detailed description of its operating steps, given hereinafter by way of non-limitative example.

According to the invention, a first step of the method consists in impregnating a paper substrate of the normally commercially available type or of a type prepared for the application of transfers (of the self-peeling kind with or without collodion) and printed with offset or flexographic or rotogravure or screen-printing methods (according to the ink used) and in which pigments known as part of the family of disperse inks and/or sublimatic inks are deposited within the inks, with an aqueous solution of a solvent which activates the print on the substrate and is capable of activating the plastic.

The aqueous solution is suitably adjusted as a function of the plastic to be colored.

The solvent must be capable of etching the surface to be treated, or causing pore swelling, in which case it can be a swelling agent, or opening or of partially solubilizing the plastic material to be colored.

The pigments of the disperse ink and sublimatic family have a modest color yield in the visual appearance of the print and do not represent the final appearance to be obtained.

The color, in this step, has a washed-out appearance because the particles of pigment inside the print are in an insoluble solid form.

By way of example, acetates, glycols and ketones can be used as solvent products: ethylene glycol acetate in an alcohol solution and water and propylene glycol are adapted in particular for ABS.

The paper substrate is then placed so as to cover the parts of the object to be treated and the plastic material whose surface has been activated beforehand, for example by the above solvents, increases its adhesiveness.

The effect is to make the surface of the plastic to be treated adhesive, with a greater degree of adhesiveness than the paper substrate after impregnation.

The pigments are transferred from the paper substrate to the surface being treated.

Even after this step, the pigment particles are in insoluble solid form.

The final step consists in fixing and simultaneously activating the pigments in the plastic material by passing the parts being treated through an atmosphere of a solvent product.

This passage must be performed in a very short time which is in any case sufficient to fix and activate the pigments on the surface whereon they are deposited and is in any case such as to affect only the surface of the object and not cause unwanted deformations thereof.

In any case, the vapors of the solvent or solvent mix must be low-boiling, preferably in the 55–100° C. range, for example 55–60° C. in the case of acetone.

The pigment particles, due to the exposure to these vapors, undergo true localized solubilizations which simultaneously diffuse superficially in the plastic material, becoming monolithic therewith and bringing out the real effect of the dye.

The employed solvent product must have affinity for the pigment; in particular, acetone, mentioned earlier, can be suitable.

Practical tests have shown that the method has achieved the intended aim and objects of the present invention.

In particular, in the first step the method is performed at a cold temperature or in any case at temperature ranges which are considerably lower than those whereat the plastic material softens, with easily available materials and with simple operating steps.

This of course has a positive effect on costs.

The method thus conceived is susceptible of numerous modifications and variations, all of which are within the scope of the inventive concept.

In practice, the materials employed, so long as they are compatible with the contingent use, may be any according to requirements.

What is claimed is:

1. A method for surface coloring plastic objects after manufacture, comprising the steps of:

impregnating a printed paper substrate with an aqueous solution of a solvent which activates the print and is capable of activating the plastic to be treated, wherein said paper substrate is printed with inks which comprises disperse and/or sublimatic pigments;

covering parts of the object to be treated with the paper substrate, so as to transfer the print from the paper to the object parts;

removing the paper substrate and subjecting the treated parts to drying;

introducing the treated parts into an atmosphere of vapors of a solvent for said pigments, for a time sufficient to activate the pigments and fix them to the plastic parts on which they are transferred.

2. The method according to claim 1, wherein said aqueous solution which activates the surfaces to be treated comprises a solvent for the plastic which etches the object to be treated, and/or a swells or opens the pores of said plastic.

3. The method according to claim 2, wherein said vapors of a solvent for said pigments comprise vapors of a solvent or of a mixture of solvents which have boiling temperatures of between 55 and 100° C.

* * * * *

UNITED STATES PATENT AND TRADEMARK OFFICE

CERTIFICATE OF CORRRECTION

PATENT NO. : 5,980,588
DATED : November 9, 1999
INVENTOR(S) : Osvaldo Valmassoi

It is certified that error appears in the above-identified patent and that said Letters Patent is hereby corrected as shown below: On the title page: Item [56] insert the following:

U. S. PATENT DOCUMENTS

| EXAMINER INITIAL | | PATENT NUMBER | ISSUE DATE | PATENTEE | CLASS | SUBCLASS | FILING DATE IF APPROPRIATE |
|---|---|---|---|---|---|---|---|
| | | 3 8 3 9 9 5 6 | 10/1974 | J. Gaynor et al. | 101 | 472 | |
| | | 4 1 6 9 1 6 9 | 09/1979 | T. Kitabatake | 427 | 149 | |

FOREIGN PATENT OR PUBLISHED FOREIGN PATENT APPLICATION

| | | DOCUMENT NUMBER | PUBLICATION DATE | COUNTRY OR PATENT OFFICE | CLASS | SUBCLASS | TRANSLATION YES | TRANSLATION NO |
|---|---|---|---|---|---|---|---|---|
| | | 2 1 2 6 1 6 3 | 03/1984 | Great Britain | | | | |
| | | 2 2 4 8 8 0 0 | 04/1992 | Great Britain | | | | |
| | | 0 5 1 8 1 8 6 | 12/1992 | Europe | | | | |

The assignee should read a follows:

[73] Assignee: Aurochim Industria S.r.l., Lozzo di Cadore, Italy

Signed and Sealed this

Eighteenth Day of July, 2000

*Attest:*

Q. TODD DICKINSON

*Attesting Officer*

*Director of Patents and Trademarks*